US007549464B2

(12) United States Patent
Franz et al.

(10) Patent No.: US 7,549,464 B2
(45) Date of Patent: Jun. 23, 2009

(54) HEAT EXCHANGER BLOCK

(75) Inventors: Marcus Franz, Schwabmünchen (DE); Jürgen Künzel, Thierhaupten (DE)

(73) Assignee: SGL Carbon AG, Wiesbaden (DE)

( * ) Notice: Subject to any disclaimer, the term of this patent is extended or adjusted under 35 U.S.C. 154(b) by 211 days.

(21) Appl. No.: 11/510,241

(22) Filed: Aug. 25, 2006

(65) Prior Publication Data

US 2007/0044947 A1 Mar. 1, 2007

(30) Foreign Application Priority Data

Aug. 25, 2005 (EP) ..... 05018507

(51) Int. Cl.
*F28F 3/14* (2006.01)
*F24H 3/00* (2006.01)

(52) U.S. Cl. ..... 165/170; 165/166; 165/130

(58) Field of Classification Search ..... 165/166, 165/167, 170, 80.3, 80.4, 148, 152, 178, 165/130–131, 49, 56
See application file for complete search history.

(56) References Cited

U.S. PATENT DOCUMENTS

| | | | | | |
|---|---|---|---|---|---|
| 629,223 | A | * | 7/1899 | Walther | 165/130 |
| 1,662,870 | A | * | 3/1928 | Stancliffe | 165/166 |
| 2,083,028 | A | * | 6/1937 | Livar | 165/130 |
| 2,566,929 | A | * | 9/1951 | Lopker | 165/170 |
| 4,714,107 | A | * | 12/1987 | Adsett | 165/166 |
| 4,771,826 | A | * | 9/1988 | Grehier et al. | 165/166 |
| 5,228,515 | A | | 7/1993 | Tran | |
| 5,383,517 | A | | 1/1995 | Dierbeck | |
| 6,000,132 | A | * | 12/1999 | Butler | 29/890.03 |
| 6,071,593 | A | * | 6/2000 | Lang et al. | 428/167 |
| 6,131,648 | A | | 10/2000 | Rasmussen | |

FOREIGN PATENT DOCUMENTS

| | | |
|---|---|---|
| AT | OE 338 957 | 9/1977 |
| DE | 508 695 | 10/1930 |
| DE | 296 04 521 U1 | 8/1996 |
| EP | 0 136 481 A3 | 4/1985 |
| EP | 1 001 240 A1 | 5/2000 |

* cited by examiner

*Primary Examiner*—Tho v Duong
(74) *Attorney, Agent, or Firm*—Laurence A. Greenberg; Werner H. Stemer; Ralph E. Locher

(57) ABSTRACT

A heat exchanger block includes two plates having abutting surfaces with grooves forming passages in which gaseous medium to be cooled flows. Spaces through which a cooling medium flows and which directly adjoin outer surfaces of the plates are provided in the heat exchanger block.

9 Claims, 6 Drawing Sheets

HEAT EXCHANGER BLOCK

CROSS-REFERENCE TO RELATED APPLICATION

This application claims the priority, under 35 U.S.C. §119, of European Patent application 05 018 507.3-2301, filed Aug. 25, 2005; the prior application is herewith incorporated by reference in its entirety.

BACKGROUND OF THE INVENTION

1. Field of the Invention

The present invention relates to a heat exchanger block.

German Utility Model DE 296 04 521 U1 discloses a heat exchanger body composed of plates made of graphite. Passage systems for two media are disposed inside the heat exchanger body.

The passages for the gaseous medium giving off heat (referred to below as flue-gas passages) are formed by grooves which are incorporated in abutting surfaces of the plates and between which ribs remain. At least two plates of that kind are combined with one another in such a way that the grooves in the abutting surfaces of the two plates complement one another and in that way form passages which are defined by the abutting ribs of both plates.

The passages for the second medium to be heated (referred to below as cooling medium) are constructed as bores passing through the plates. The thickness of the plates is selected in such a way that only a thin material barrier which does not impair the heat transfer to a great extent is located between the two passage systems. However, the thickness of that material barrier is sufficient to separate the passage systems from one another in a fluid-tight manner and ensure mechanical stability.

Those surfaces of the plates which face outwards are flat. The plates are held together by adhesive or through the use of seals and tie rods. Several pairs of plates can be placed side by side or against one another. That modular type of construction permits specific adaptation of the capacity of the heat exchanger for various requirements.

The passage systems may be disposed parallel to one another or perpendicularly to one another, depending on whether it is intended to direct the media in counter-flow or co-current flow or in cross-flow. However, a considerably higher construction and processing cost is required for directing the media in parallel, in order to achieve the separation of the flow to be cooled and the flow to be heated.

If the media are directed in parallel, the orifices of both passage systems lie on the same end faces of the plates. That is to say, respective connection systems (head pieces) are to be provided for two separate media flows at the relevant end faces.

In order to keep the material barrier between the two passage systems as small as possible, the bores run between the grooves incorporated in the plate surfaces, i.e. they lie on a plane close to or above the bottoms of the grooves. The passage systems are, as it were, interlaced. The result thereof is that the orifices of the flue-gas passages and the orifices of the cooling passages lie very close together at the end faces of the plates. Specially constructed head pieces are therefore necessary for feeding and distributing the media to the respective passage system or for collecting the partial flows from the passages and for removing the media. The head pieces enable different media to be supplied and removed separately in the narrowest space.

As an alternative, it is proposed in German Utility Model DE 296 04 521 U1 to close the ends of the bores at the end faces, for example by plugs adhesively bonded in place, and to provide branch bores from the plate surfaces to the bores forming the cooling passages, so that the supply and removal of the cooling medium can be effected from the plate surface. Although that variant solves the problem of space at the end faces, it is even more complicated in production, since the end-face orifices have to be closed in a fluid-tight manner at each bore and two branch bores must additionally be provided.

Directing the media in cross-flow is therefore preferred in practice, although more effective cooling can be achieved by directing the media in counter-flow.

The flue-gas passages are preferably constructed in such a way that firstly a high ratio of heat transfer area (wall area) to passage volume is achieved and secondly the cross section of flow is sufficient in order to ensure the outflow of the gases by natural convection. This is achieved by passages in the form of slots having a high ratio of depth to width. The grooves forming the flue-gas passages are produced mainly by milling.

The passages for the cooling medium always have a circular cross section, since they are bored. However, the construction of those passages as bores is disadvantageous due to the high processing efforts.

In addition, the limitation to circular passage cross sections due to the boring operation is unfavorable for the heat transfer. If the form of the passages is fixed, the heat transfer coefficient alpha between wall area and cooling medium, which in turns depends, inter alia, on the flow state of the cooling medium and on the geometrical shape of the heat transfer area, can only be increased by increasing the flow velocity of the cooling medium in the bores.

SUMMARY OF THE INVENTION

It is accordingly an object of the invention to provide a heat exchanger block, which overcomes the hereinafore-mentioned disadvantages of the heretofore-known devices of this general type and which is composed of plates in such a way that the cooling medium is not directed through bores. In addition, the heat exchanger according to the invention should permit the gas flow which is to be cooled and the cooling medium, to be directed in counter-flow without a high structural cost.

With the foregoing and other objects in view there is provided, in accordance with the invention, a heat exchanger block. The heat exchanger block comprises two horizontal plates having mutually adjoining surfaces and mutually abutting ribs defining grooves in the mutually adjoining surfaces of the two horizontal plates. The grooves complement one another and form flow passages, defined by the mutually abutting ribs of the two horizontal plates, for a gaseous medium. Hoods are each placed onto a respective one of the two horizontal plates and have edges. The two horizontal plates have outwardly directed surfaces acting as heat transfer areas and defining, along with the hoods, spaces adjoining the outwardly directed surfaces, for a cooling medium flow. Encircling seals are provided for sealing gaps between the outwardly directed surfaces of the two horizontal plates and the edges of the hoods. A seal is provided for sealing a gap between the two horizontal plates. A device is provided for holding the block together.

Therefore, the object of the invention is achieved in that, in the heat exchanger block, the heat transfer to the cooling medium takes place through the outwardly pointing surfaces of the two plates enclosing the flue-gas passages. For this purpose, spaces through which a cooling medium flows and which directly adjoin the outwardly pointing surfaces of the plates enclosing the flue-gas passages are provided in the heat exchanger block according to the invention.

Other features which are considered as characteristic for the invention are set forth in the appended claims.

Although the invention is illustrated and described herein as embodied in a heat exchanger block, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
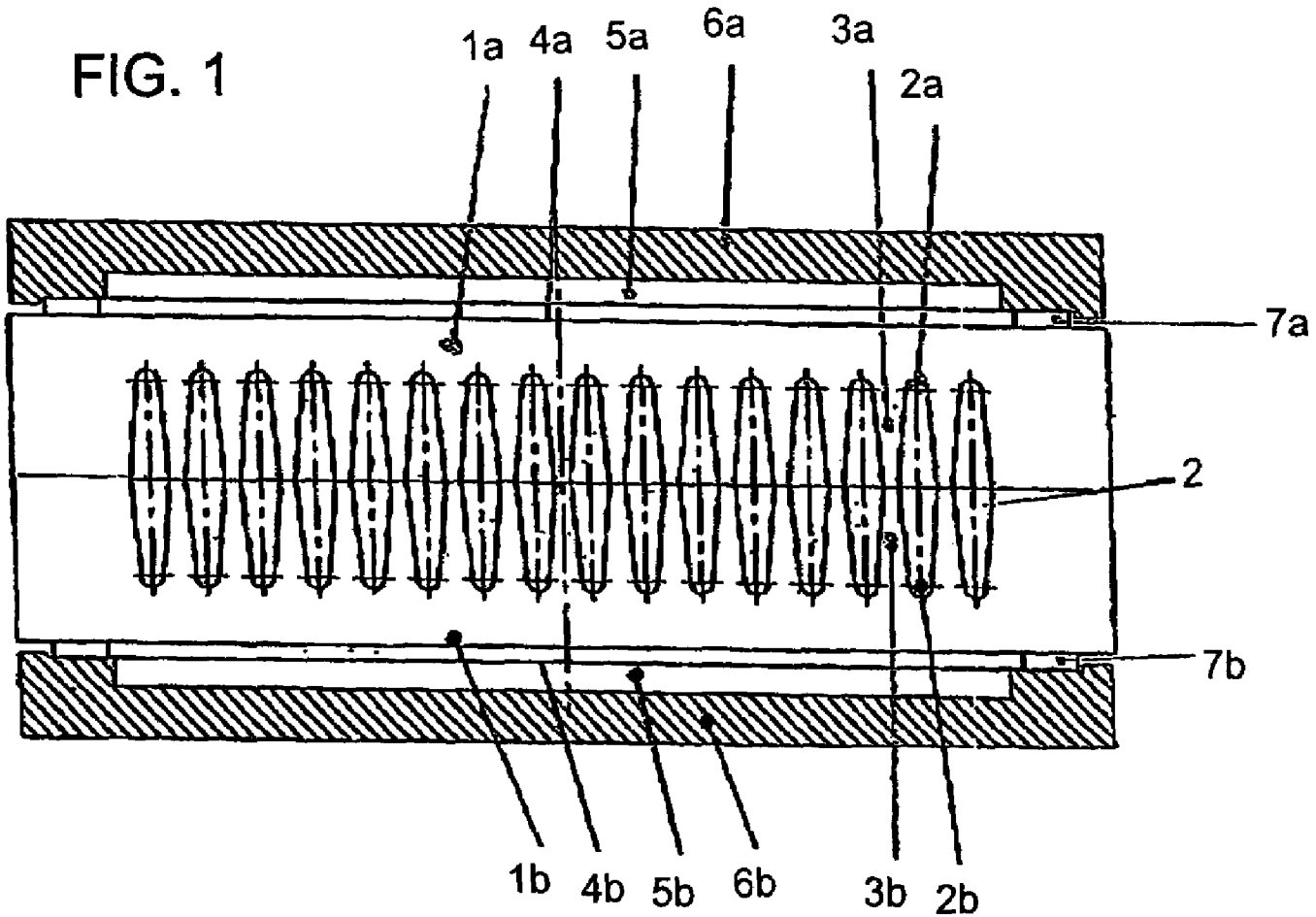
FIG. 1 is a diagrammatic, cross-sectional view of a structure of a heat exchanger block according to the invention.

Referring now to the figures of the drawings in detail and first, particularly, to FIG. 1 thereof, there is seen a heat exchanger block according to the invention that includes two plates 1*a*, 1*b* having surfaces adjoining one another which are provided with grooves 2*a*, 2*b* that are defined by ribs 3*a*, 3*b*. The grooves 2*a*, 2*b* in the two plate surfaces complement one another and in this way form flow passages 2 for a gaseous medium which are defined by abutting ribs 3*a*, 3*b* of the two plates 1*a*, 1*b*. Spaces 5*a*, 5*b* which adjoin outwardly pointing surfaces 4*a*, 4*b*, acting as heat transfer areas, of the horizontal plates 1*a*, 1*b* and through which a cooling medium flows, are defined by respective hoods 6*a*, 6*b* placed onto the plates 1*a*, 1*b*. Encircling seals 7*a*, 7*b* seal gaps between the plate surfaces 4*a*, 4*b* and edges of the hoods 6*a*, 6*b*. A seal is provided for the gap between the plates 1*a*, 1*b* and a device 8 is provided for holding the block together.

For the sake of clarity, the heat exchanger block according to the invention is always shown horizontally in FIGS. 1 to 5, i.e. the flow or flue-gas passages 2 run in a horizontal direction. However, this is not intended to signify any limit to a specific type of setup or installation. Instead, the heat exchanger block according to the invention may, of course, also be operated in an upright position (with the flow or flue-gas passages 2 extending vertically). A person of skill in the art will decide on the type of setup with reference to the respective application.

As is known from German Utility Model DE 296 04 521 U1, the plates 1*a*, 1*b*, which enclose the flue-gas passages 2, can be produced from synthetic graphite, the pores of which have been closed by impregnation, or from a composite material of a polymer matrix having a high proportion of thermally conductive particles distributed therein, for example particles of graphite or silicon carbide.

However, the present invention is not tied to these materials. The plates 1*a*, 1*b* could in principle also be produced from metallic materials. When selecting the material for the plates 1*a*, 1*b*, the temperature and corrosiveness of the gaseous medium to be cooled are to be taken into account.

The considerations already explained in German Utility Model DE 296 04 521 U1 apply with regard to the construction of the flue-gas passages 2. In order to obtain a passage cross section which is both fluidically favorable and provides a large heat transfer area, grooves 2*a*, 2*b* having a large depth compared with their width are preferred. The ratio of groove width to groove depth may be up to about 1:50, with a ratio of about 1:1 to 1:10 being especially favorable for a graphite apparatus based on production and processing considerations. When the plates 1*a*, 1*b* are combined, the narrow deep grooves 2*a*, 2*b* complement one another to form slot-shaped passages 2.

The thickness of the plates 1*a*, 1*b* is selected in such a way that the distance between the bottoms of the grooves 2*a*, 2*b* forming the flue-gas passages 2 and those surfaces 4*a*, 4*b* of the plates 1*a*, 1*b* which act as heat transfer areas, is as small as possible, but a material layer which is sufficient for ensuring the mechanical stability and fluid tightness is left. In the case of graphite materials, the minimum layer thickness necessary for stability is about 10 to 15 mm.

The ribs 3*a*, 3*b*, in addition to defining the flue-gas passages 2, also serve to support the plates 1*a*, 1*b*, which are loaded by the adjacent spaces 5*a*, 5*b* through which a cooling medium flows, and by the hoods 6*a*, 6*b* closing off these spaces.

Metallic materials, for example cast iron, are suitable materials for the hoods 6*a*, 6*b*. The hoods 6*a*, 6*b*, which close off the spaces 5*a*, 5*b* through which a cooling medium flows, do not come into contact with the hot and corrosive flue gas. Therefore, the materials for the hoods 6*a*, 6*b* do not have to meet such high requirements with regard to corrosion resistance. Thus, in the heat exchanger block according to the invention, the use of corrosion-resistant, but expensive and difficult-to-machine materials such as graphite or ceramic, can be restricted to those regions in which such materials are absolutely necessary due to the contact with hot corrosive media.

In addition, the delimitation of the space 5*a*, 5*b* through which the cooling medium flows by hoods 6*a*, 6*b* permits virtually any desired configuration of the flow guidance of the cooling medium.

The edges of the hoods 6*a*, 6*b* are sealed off from the plate surfaces 4*a*, 4*b* by encircling flat gaskets or O-ring seals 7*a*, 7*b*.

The flexible seals 7*a*, 7*b* compensate for the differences in the thermal expansion between the plates 1*a*, 1*b* through which the hot flue gas flows and the hoods 6*a*, 6*b*, which are relatively cool in comparison.

The gap between the plates 1*a*, 1*b* must also be sealed off. This can be done by an adhesive. For example, plates 1*a*, 1*b* made of graphite could be cemented together. However, such a permanent connection of the plates 1*a*, 1*b* enclosing the flue-gas passages 2 by an adhesive has the disadvantage that the plates 1*a*, 1*b* can then no longer be released from one another nondestructively.

It is therefore preferred to hold together the block including the hoods 6*a*, 6*b* and the plates 1*a*, 1*b* through the use of releasable clamping devices 8, for example tie rods, and the gap between the plates 1*a*, 1*b* is sealed off through the use of a soft packing. This construction permits complete dismantling, including separation of the plates 1*a* and 1*b* from one another. This facilitates maintenance work, such as the cleaning of the flue-gas passages, for example.

Figure 2:
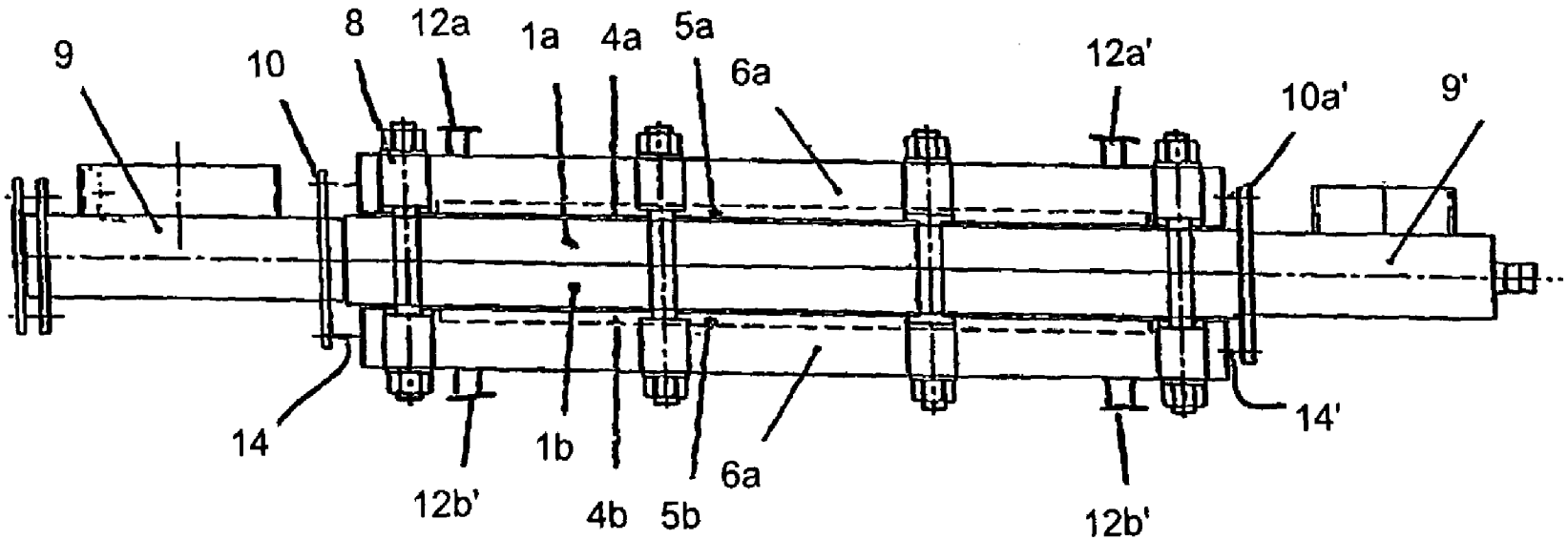
FIG. 2 is a side-elevational view of a heat exchanger block according to the invention having flue-gas connections.

The feeding and discharge of the gaseous medium into and respectively from the flue-gas passages 2 is effected through connection hoods or connections 9, 9'. FIG. 2 shows a heat exchanger block according to the invention with connection hoods 9, 9' fastened thereto for the admission and discharge of a gaseous medium, e.g. flue gas from an internal combustion unit. The construction of such connection hoods is known and is therefore not described in any more detail. It may only be mentioned that the hood 9' for the discharge of the cooled gaseous medium is provided, if need be, with a condensate outflow device if the cooled gaseous medium contains condensable constituents.

It is known from the prior art to restrain the gas connection hoods 9, 9' by tie rods which extend over the outer sides of the heat exchanger block. However, this has the disadvantage that the flue-gas connection hoods cannot be removed separately due to the common restraint by the tie rods.

The construction of the heat exchanger according to the invention opens up the possibility of releasably fastening the flue-gas connections 9, 9' independently of one another at the respective hoods 6*a* and 6*b* through the use of screws 14,14'and a respective retaining ring 10, 10'. Fitting and maintenance operations at the flue-gas connections 9, 9' are therefore possible independently of one another.

Connections 12*a*, 12*b* for feeding the cooling medium into the flow spaces 5*a*, 5*b* and connections 12*a*', 12*b*' for removing the heated cooling medium, are provided on the hoods 6*a*, 6*b*.

In order to increase the size of the heat transfer area, a plurality of heat exchanger blocks according to the invention can be disposed side by side or one after the other.

Due to the simplified form of the plates 1*a*, 1*b* which, in contrast to the prior art, do not have any bores, those production techniques which do not work in a material-removing manner can also be used for their production. Techniques such as compression molding, extrusion and the like are especially advantageous, since in this way the processing cost and the material losses which are associated with machining are avoided.

Figure 3:
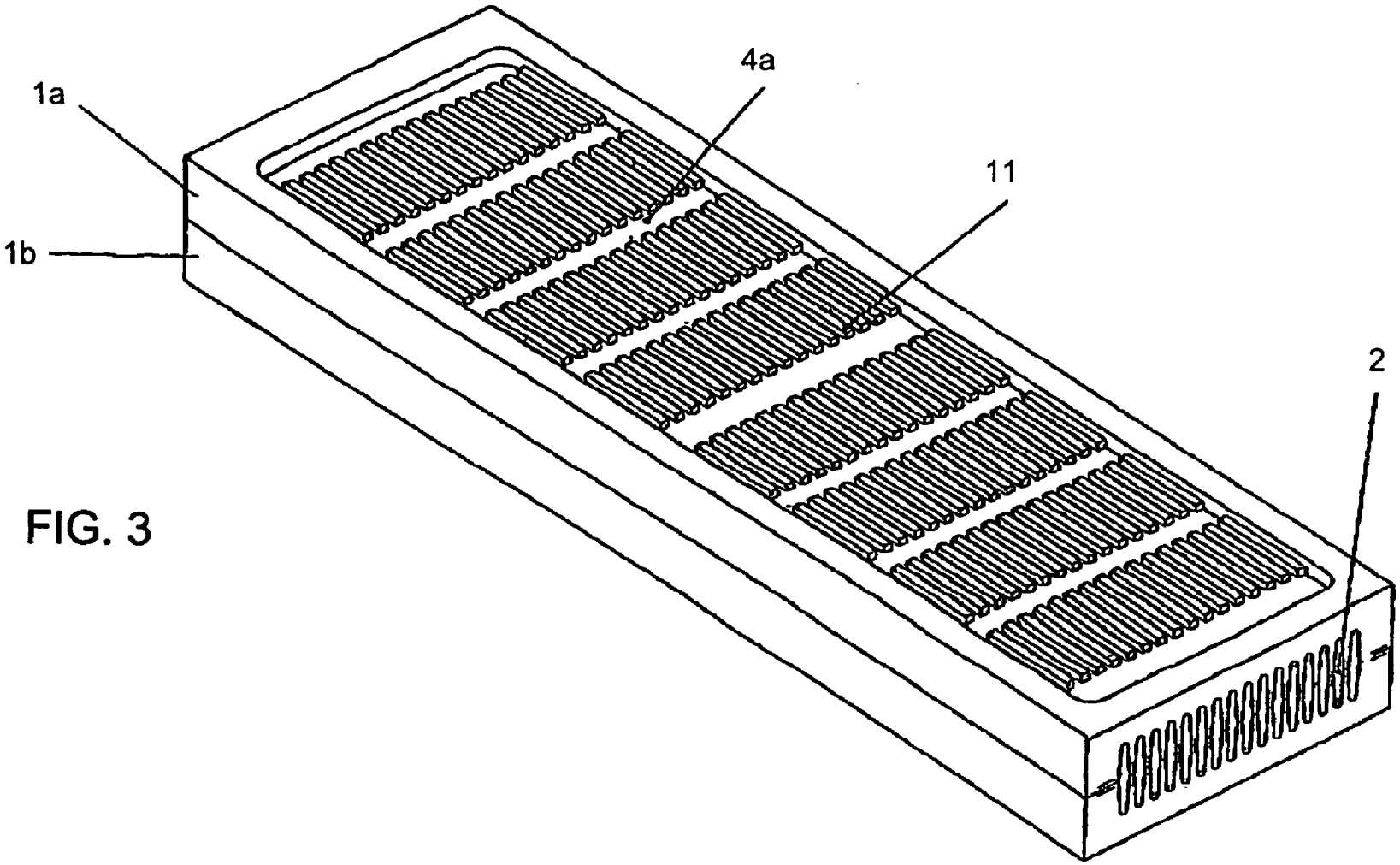
FIG. 3 is a perspective view of an advantageous configuration of the heat exchanger block according to the invention.

In an advantageous development of the heat exchanger block according to the invention, which is shown in FIG. 3, those surfaces 4*a*, 4*b* of the plates 1*a*, 1*b* which act as heat transfer areas are provided with profile structures 11 which increase the size of the area available for the heat transfer and/or increase the turbulence of the flow of the cooling medium. Such structures 11 may contain, for example, channels, beads, ribs, webs, projections, e.g. knobs, or structural elements of that kind, or combinations thereof. For example, ribs 15 offset from one another or ribs having apertures 16 offset from one another are advantageous, because in this way the turbulence of the cooling medium is increased. Such profile structures as are used in plate-type heat exchangers and disclosed, for example, by European Patent EP 0 203 213 B1, are especially advantageous.

If the space 5*a*, 5*b* through which the cooling medium flows is incorporated in the surface 4*a*, 4*b* of the plate 1*a*, 1*b*, as is shown in FIG. 3, the hood 6*a*, 6*b* can be constructed as a flat plate which rests on the raised edge, provided with the encircling seal 7*a*, 7*b*, of the structured plate surface 4*a*, 4*b* and is supported by the structural elements 11 projecting from the plate surface 4*a*, 4*b*.

However, such support by the structural elements is not absolutely necessary, since a small gap between the structural elements 11 and the hoods 6*a* and 6*b* can also be tolerated from the process point of view and does not impair the function.

Figure 4:
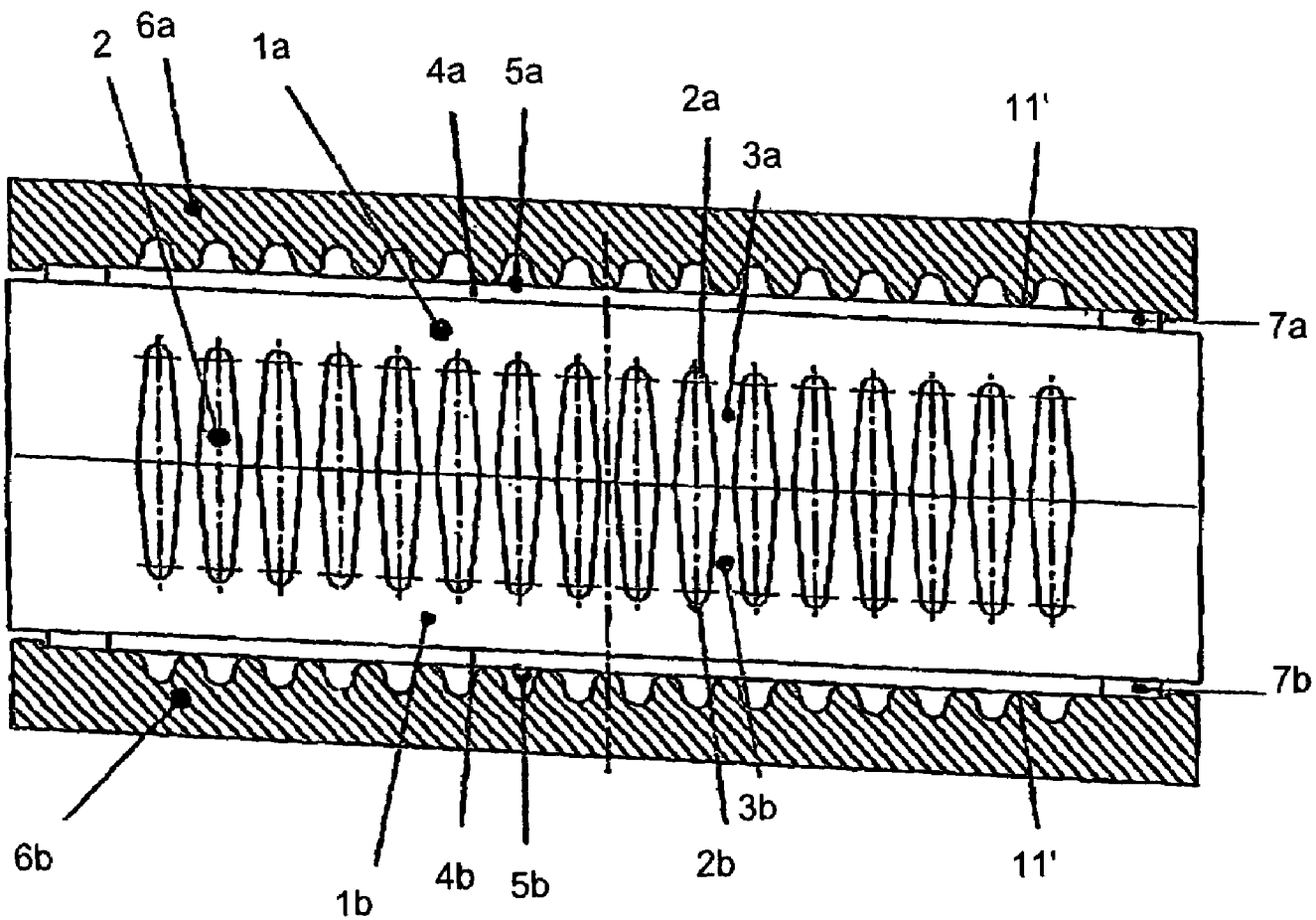
FIG. 4 is a cross-sectional view of a further advantageous configuration of the heat exchanger block according to the invention.

Alternatively or additionally, as is seen in FIG. 4, the inner sides of the hoods 6*a*, 6*b*, which close off the respective space 5*a*, 5*b* through which a cooling medium flows, may be provided with profile structures 11' suitable for generating turbulence.

The variant of FIG. 4 having structured inner sides of the hoods 6*a*, 6*b* is preferred over the variant of FIG. 3 having structured heat transfer areas 4*a*, 4*b* of the plates 1*a*, 1*b*, because the hoods 6*a*, 6*b* are made of metallic materials, which are easier to machine than graphite or ceramic materials.

The structures 11 and 11' are also suitable for purposefully directing the flow of the cooling medium, to be precise virtually independently of the placement and the type of the connections 12*a*, 12*b* for feeding the cooling medium and the connections 12*a*', 12*b*' for discharging the cooling medium. The problem known from the prior art, which is that when the media is directed in parallel, connections for two different media flows to be kept separate from one another have to be accommodated at the same end faces or side faces of the block in the narrowest space, is thus avoided in the heat exchanger block according to the invention.

A pure counter-flow of flue gas and coolant, which counter-flow is especially effective for the heat transfer, can therefore be achieved by appropriate structuring of the heat transfer areas 4*a*, 4*b* or/and of the inner sides of the hoods 6*a*, 6*b* in the heat exchanger according to the invention.

EXEMPLARY EMBODIMENT

Three heat exchangers which must perform the same cooling task were constructed.

Figure 5:
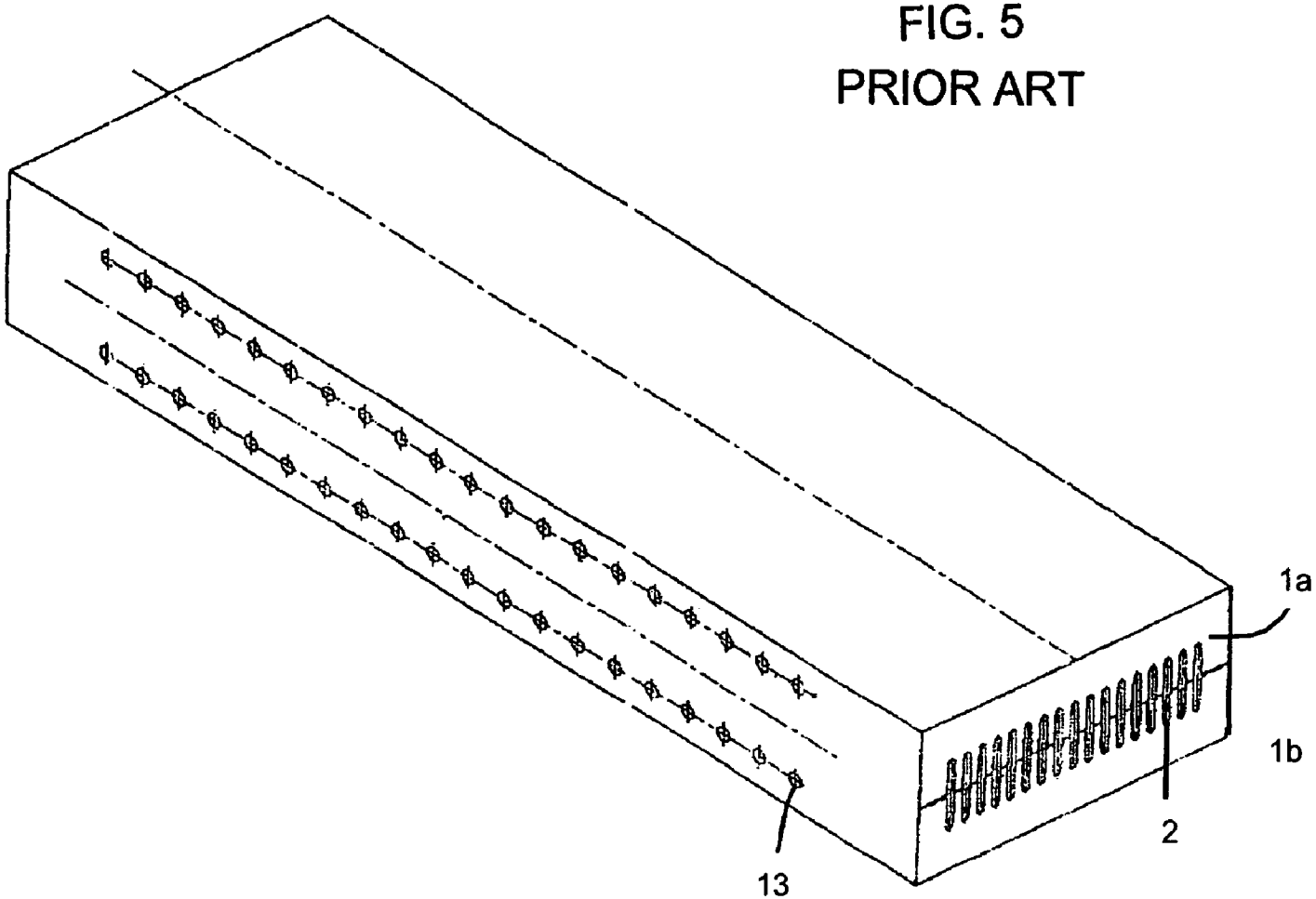
FIG. 5 PRIOR ART
FIG. 5 is a perspective view of a heat exchanger block according to the prior art, which is used as a comparative example.
Figure 6:
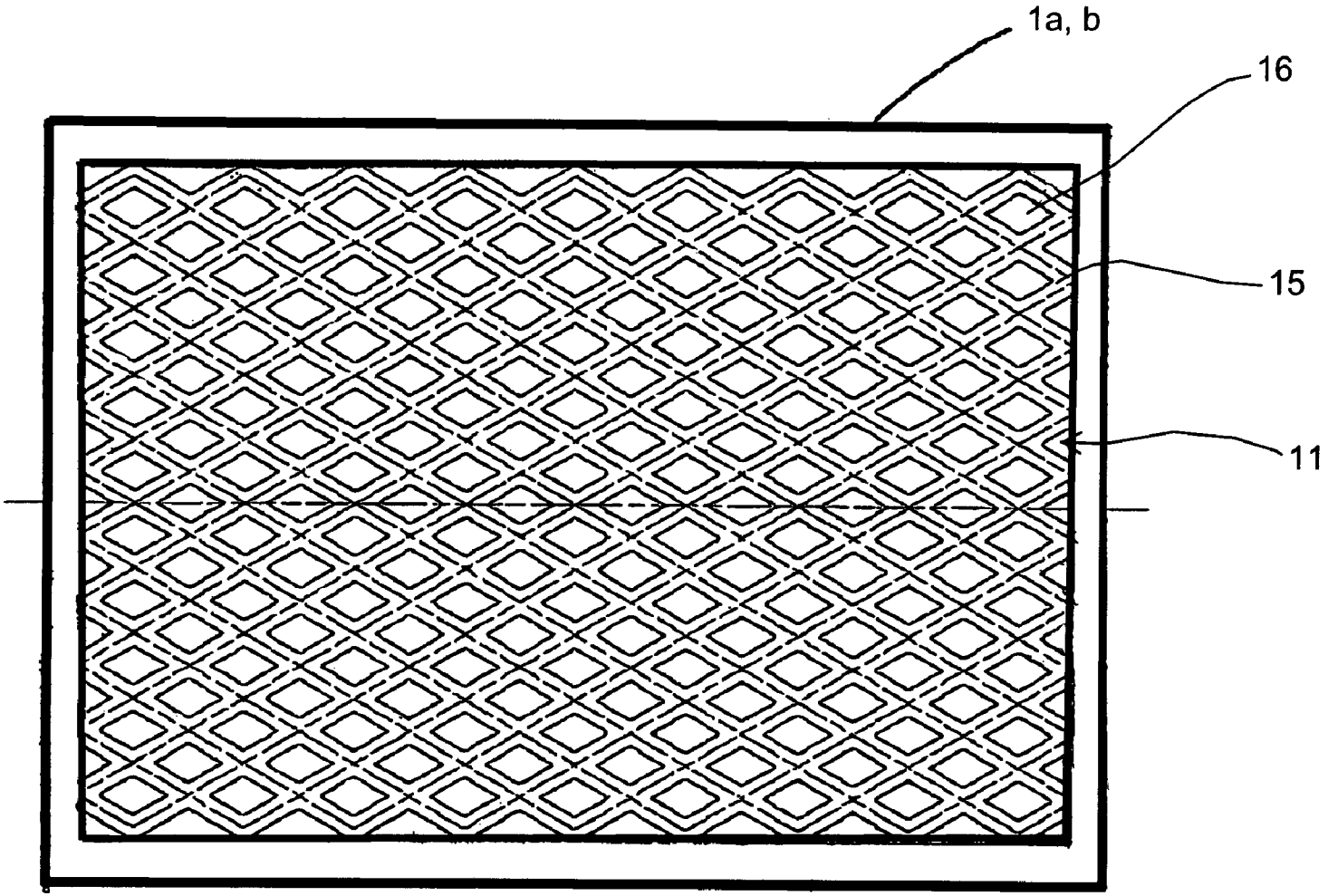
FIG. 6 is a plan view of the heat exchanger block according to the invention having ribs and apertures offset from one another.

The first heat exchanger, according to the prior art known from German Utility Model DE 296 04 521 U1, has cooling passages which are formed by bores 13 in the plates 1*a*, 1*b*, as in FIG. 5.

In the second heat exchanger according to the invention, the heat given off by the flue gases is transferred to the cooling medium through the flat outer surfaces 4*a*, 4*b* of the plates 1*a*, 1*b*, with the cooling medium flowing over the outer surfaces 4*a*, 4*b*, as in FIG. 1.

In the third heat exchanger, according to a development of the present invention, the outwardly-pointing or directed surfaces 4*a*, 4*b* of the plates 1*a*, 1*b* are provided with a flow structure 11 like the plates of a plate-type heat exchanger, as in FIG. 3.

The flow velocity of the cooling medium in the bores of the first heat exchanger is assumed as a constant quantity for all three heat exchangers, i.e. the cooling medium flows at the same velocity over the heat transfer areas of all three heat exchangers.

The heat transfer coefficient alpha is 50% higher in the heat exchanger according to the invention having a flat heat transfer area, over which the cooling medium flows, as compared with that according to the prior art having bores through which the cooling medium flows. In the heat exchanger according to the invention having a structured heat transfer area, the increase in the heat transfer coefficient alpha is even 3.5 times that of the prior art.

The improvement in the heat transfer to the cooling water, which is made possible by the configuration of the heat exchanger according to the invention, is especially advantageous when the heat transfer coefficient on the gas side is also high. This is the case when the gas to be cooled contains condensable portions.

Since the heat transfer coefficient alpha, through the overall heat transmission coefficient k, determines the transmittable thermal output in addition to the heat transfer area and the temperature difference, the heat transfer area, due to the increased heat transfer coefficient, can be reduced at the same cooling capacity in the embodiment of the heat exchanger according to the invention. Thus, under otherwise identical boundary conditions, the heat exchanger can be constructed to be more compact than is possible, for example, with the prior art described in German Utility Model DE 296 04 521 U1.

We claim:

1. A heat exchanger block, comprising:

two horizontal plates having mutually adjoining surfaces and mutually abutting ribs defining grooves in said mutually adjoining surfaces of said two horizontal plates, said grooves complementing one another and forming flow passages, defined by said mutually abutting ribs of said two horizontal plates, for a gaseous medium;

hoods each being placed onto a respective one of said two horizontal plates and having edges;

said two horizontal plates having outwardly directed surfaces acting as heat transfer areas and defining, along with said hoods, spaces adjoining said outwardly directed surfaces, for a cooling medium flow;

encircling seals for sealing gaps between said outwardly directed surfaces of said two horizontal plates and said edges of said hoods;

a seal for a gap between said two horizontal plates;

a device for holding the block together;

flue-gas connections; and screws and a retaining ring fastening each of said flue-gas connections to said hoods.

2. The heat exchanger block according to claim 1, wherein said two horizontal plates are made of a material selected from the group consisting of graphite, a ceramic material and a composite material formed of a polymer matrix having a high proportion of thermally conductive particles distributed therein, and said hoods are made of a metallic material.

3. The heat exchanger block according to claim 1, wherein said encircling seals for sealing said gaps between said outwardly directed surfaces of said two horizontal plates and said edges of said hoods, are O-ring seals.

4. The heat exchanger block according to claim 1, wherein said device for holding the block together is in the form of releasable clamping connections, and said seal for said gap between said two horizontal plates is a soft packing.

5. The heat exchanger block according to claim 1, wherein said hoods have inner surfaces, and at least one of said outwardly directed surfaces of said two horizontal plates or said inner surfaces of said hoods have profile structures.

6. The heat exchanger block according to claim 5, wherein said profile structures contain at least one structural element selected from the group consisting of channels, beads, ribs, webs, projections and knobs.

7. The heat exchanger block according to claim 5, wherein said profile structures contain ribs offset from one another or ribs having apertures offset from one another.

8. The heat exchanger block according to claim 5, wherein said profile structures generate turbulence in the cooling medium flow.

9. The heat exchanger block according to claim 1, wherein said flow passages are flue-gas passages, and the cooling medium is directed into said spaces in counter-flow to a medium to be cooled in said flue-gas passages.

* * * * *